US011306711B2

(12) United States Patent
Ting et al.

(10) Patent No.: US 11,306,711 B2
(45) Date of Patent: Apr. 19, 2022

(54) MINIATURE COOLING SYSTEM

(71) Applicant: CHUNG-YUAN CHRISTIAN UNIVERSITY, Chung Li (TW)

(72) Inventors: Yung Ting, Chung Li (TW); Sheuan-Perng Lin, Chung Li (TW); Chien-Ping Wang, Chung Li (TW); Chien-Hsiang Wu, Chung Li (TW); Jun-Hao Chen, Chung Li (TW)

(73) Assignee: CHUNG-YUAN CHRISTIAN UNIVERSITY, Chung Li (TW)

( * ) Notice: Subject to any disclaimer, the term of this patent is extended or adjusted under 35 U.S.C. 154(b) by 721 days.

(21) Appl. No.: 16/117,771

(22) Filed: Aug. 30, 2018

(65) Prior Publication Data

US 2019/0309744 A1 Oct. 10, 2019

(30) Foreign Application Priority Data

Apr. 9, 2018 (TW) ..... 107112162

(51) Int. Cl.
*F04B 43/04* (2006.01)
*F04B 45/047* (2006.01)
(Continued)

(52) U.S. Cl.
CPC ..... *F04B 45/047* (2013.01); *F04B 39/06* (2013.01); *F04B 43/021* (2013.01);
(Continued)

(58) Field of Classification Search
CPC ..... F04B 39/06; F04B 43/021; F04B 43/046; F04B 45/024; F04B 45/047; F04B 49/06
See application file for complete search history.

(56) References Cited

U.S. PATENT DOCUMENTS 4,938,742 A * 7/1990 Smits ..... F04B 43/046 604/67
5,095,938 A * 3/1992 Garrison ..... B01J 4/02 137/510

(Continued)

FOREIGN PATENT DOCUMENTS

CN 204425882 U * 6/2015
CN 204425882 U 6/2015

OTHER PUBLICATIONS

CN-204425882-UE, English Translation of CN-204425882-U; Jun. 24, 2015 (Year: 2015).*

*Primary Examiner* — Dominick L Plakkoottam
*Assistant Examiner* — Charles W Nichols
(74) *Attorney, Agent, or Firm* — Muncy, Geissler, Olds & Lowe, P.C.

(57) ABSTRACT

A miniature cooling system includes a base metal sheet, a flow channel layer, a piezoelectrically actuated metal sheet, a piezoelectric boundary compression layer and two piezoelectric ceramic vibrators. The flow channel layer is located on the base metal sheet and includes a first chamber, a second chamber, an inlet channel, a linking channel and an outlet channel. The inlet channel links the outside environment to the first chamber. The linking channel links the first chamber and the second chamber. The outlet channel links the second chamber to the outside environment. The piezoelectrically actuated metal sheet is located on the flow channel layer. The piezoelectric boundary compression layer is located on the piezoelectrically actuated metal sheet. The piezoelectric boundary compression layer includes two containing areas, and the two containing areas are respectively located above the first chamber and the second chamber.

10 Claims, 11 Drawing Sheets

(51) Int. Cl.

| | |
|---|---|
| ***F04B 43/02*** | (2006.01) |
| ***F04B 45/02*** | (2006.01) |
| ***F04B 49/06*** | (2006.01) |
| ***F04B 39/06*** | (2006.01) |

(52) U.S. Cl.
CPC ..... *F04B 43/046* (2013.01); *F04B 45/024* (2013.01); *F04B 49/06* (2013.01)

(56) References Cited

U.S. PATENT DOCUMENTS

| | | | | |
|---|---|---|---|---|
| 6,247,908 | B1 * | 6/2001 | Shinohara | F04B 43/046 417/413.2 |
| 2011/0005606 | A1 * | 1/2011 | Bartels | F04B 43/046 137/14 |
| 2012/0051946 | A1 * | 3/2012 | Lee | F04B 43/046 417/53 |
| 2014/0049970 | A1 * | 2/2014 | de Bock | H05K 7/20172 362/373 |
| 2014/0248170 | A1 * | 9/2014 | Kabasawa | F04B 43/046 417/472 |

* cited by examiner

MINIATURE COOLING SYSTEM

BACKGROUND OF THE INVENTION

1. Field of the Invention

The present invention relates to a miniature cooling system; more particularly, the present invention relates to a miniature cooling system which has a strong blower-type cooling effect.

2. Description of the Related Art

The cooling solution of the prior art, which is applied in electric devices, guides heat generated by a heating element (such as a central processing unit or a graphics processing unit) to a cooling sheet or metal with a high-heat transferring feature via the package surface, and transfers the heat to a heat dissipation device (such as a fan or other cooling sheet) via the heat pipe effect, to exhaust the heat. However, the cooling method of the prior art has some disadvantages. For example, the heat transfer path for exhausting the heat is formed by many heating dissipation components, so the thermal resistance and assembly cost are high. Moreover, the cooling sheet of the prior art is generally made of aluminum alloy, but the thermal conductivity of aluminum alloy is only average; since the heating power of the current heating component is increasing, the thermal conductivity of aluminum alloy cannot meet the requirement of high power electronic devices such as tablet computers or smartphones.

In addition, the heat pipe of the prior art for dissipating the heat of the central processing unit of the notebook computer gradually faces a bottleneck. Although the improved heat dissipation method uses air as the thermal convection medium to dissipate the heat from the electronic component, the electronic component is fine and flat, so the flow channel is narrow and causes a serious pressure drop; thus, the cooling effect is poor and the feasibility is reduced.

Therefore, there is a need to provide a new thin cooling system which can be applied to a portable electronic device to solve the abovementioned problem.

SUMMARY OF THE INVENTION

It is an object of the present invention to provide a thin miniature cooling system which has a strong blower-type cooling effect.

To achieve the abovementioned object, the miniature cooling system of the present invention includes a base metal sheet, a flow channel layer, a piezoelectrically actuated metal sheet, two piezoelectric ceramic vibrators and a piezoelectric boundary compression layer. The flow channel layer is located on the base metal sheet. The flow channel layer includes a first chamber, a second chamber, an inlet channel, a linking channel and an outlet channel. The inlet channel links the outside environment to the first chamber. The linking channel links the first chamber and the second chamber. The outlet channel links the second chamber to the outside environment. The piezoelectrically actuated metal sheet is located on the flow channel layer. The piezoelectric boundary compression layer is located on the piezoelectrically actuated metal sheet. The two piezoelectric ceramic vibrators are respectively located in the two containing areas and aligned with the center of each of the two containing areas, and located on the piezoelectrically actuated metal sheet. Via the upper piezoelectric boundary compression layer and the flow channel layer, the piezoelectric component boundary of the piezoelectric ceramic vibrator is fixed effectively.

According to one embodiment of the present invention, the two piezoelectric ceramic vibrators are aligned with the center and connected to the piezoelectrically actuated metal sheet, and two parts of the piezoelectrically actuated metal sheet are exposed from the two containing areas.

According to one embodiment of the present invention, the miniature cooling system further includes a driving circuit. The driving circuit is electrically connected to the two piezoelectric ceramic vibrators for providing two driving controlling powers such that the two piezoelectric ceramic vibrators vibrate up and down with an appropriate phase difference in order to generate more effective flow in and out of the chambers, such that the internal airflow will flow effectively to achieve incoming and outgoing effects.

According to one embodiment of the present invention, the inlet channel and the vibration direction are perpendicular to each other.

According to one embodiment of the present invention, the miniature cooling system further includes a plurality of fins, and the plurality of fins are connected to the base metal sheet.

According to one embodiment of the present invention, the plurality of fins are located next to the outlet channel.

According to one embodiment of the present invention, the inlet channel, the linking channel and the outlet channel are fan-shaped nozzles. The size ratio the fan-shaped nozzle of each channel gradually becomes smaller to achieve an optimal tapering ratio such that the internal airflow will flow effectively to achieve incoming and outgoing effects.

According to one embodiment of the present invention, the inlet channel and the outlet channel respectively have a size. The range of the ratio of the size of the outlet channel to the size of the inlet channel is between 0.4 and 0.7. The fan-shaped nozzle of the outlet channel helps the fins for cooling effectively.

According to one embodiment of the present invention, the first chamber and the second chamber are both circular cavities, the two containing areas are circular grooves, and the two piezoelectric ceramic vibrators are corresponding circular films or ring films for amplifying the amplitude; or the first chamber and the second chamber are both rectangular cavities, the two containing areas are rectangular grooves, and the two piezoelectric ceramic vibrators are corresponding rectangular films or hollow square films for amplifying the amplitude.

According to one embodiment of the present invention, the two piezoelectric ceramic vibrators can even vibrate at an ultrasound frequency for modal resonance so that achieve better performance of larger flow volume and velocity and being inaudible.

BRIEF DESCRIPTION OF THE DRAWINGS

These and other objects and advantages of the present invention will become apparent from the following description of the accompanying drawings, which disclose several embodiments of the present invention. It is to be understood that the drawings are to be used for purposes of illustration only, and not as a definition of the invention.

In the drawings, wherein similar reference numerals denote similar elements throughout the several views.

DETAILED DESCRIPTION OF THE PREFERRED EMBODIMENT

Figure 1:
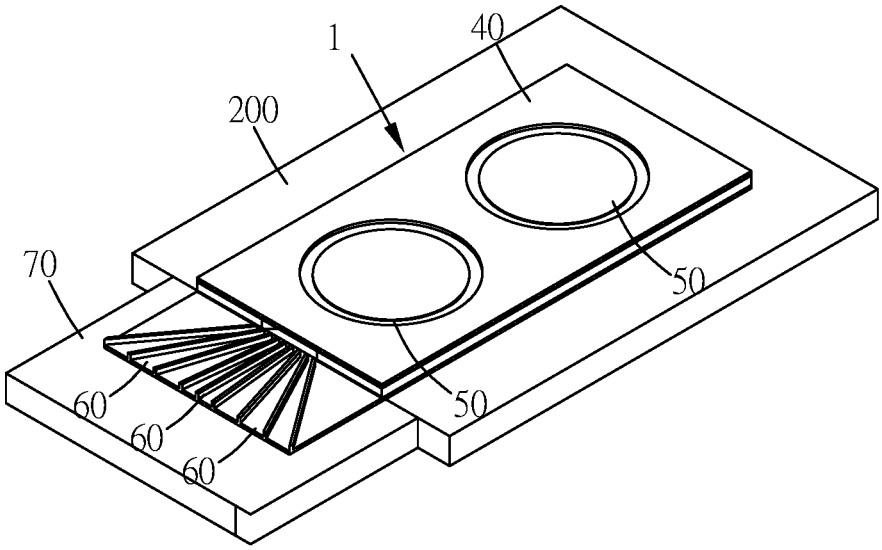
FIG. 1 illustrates a schematic drawing of the miniature cooling system installed on the electronic component of the portable electronic device in the first embodiment of the present invention.
Figure 2:
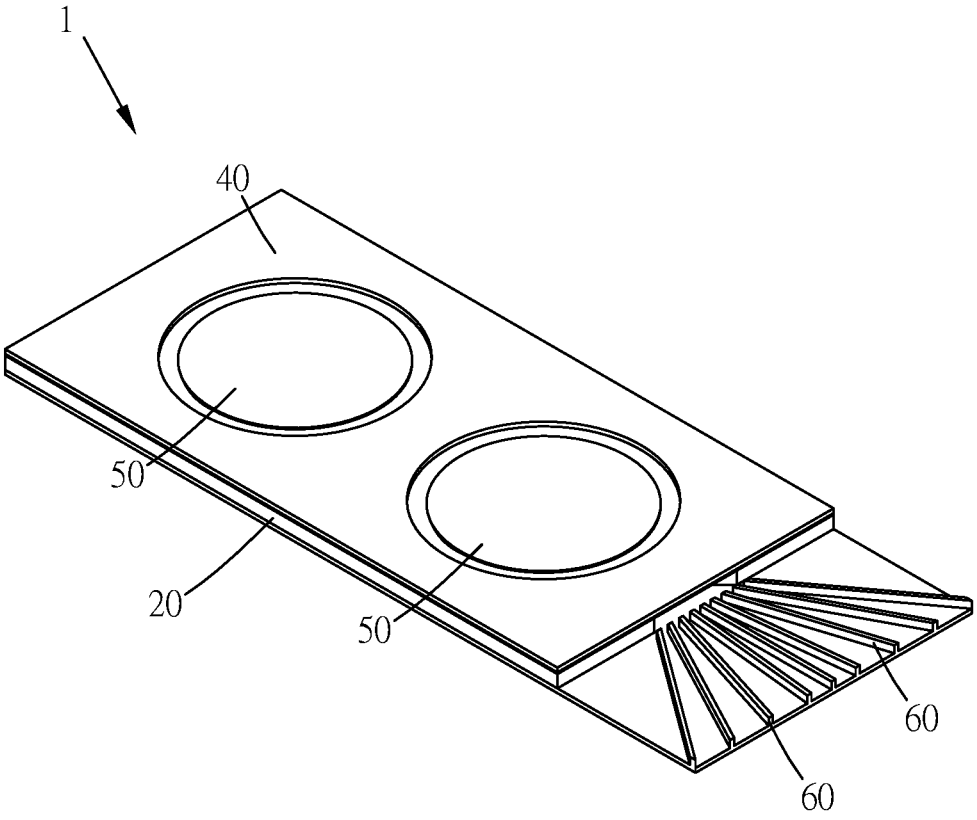
FIG. 2 illustrates a schematic drawing of the miniature cooling system in the first embodiment of the present invention.
Figure 3:
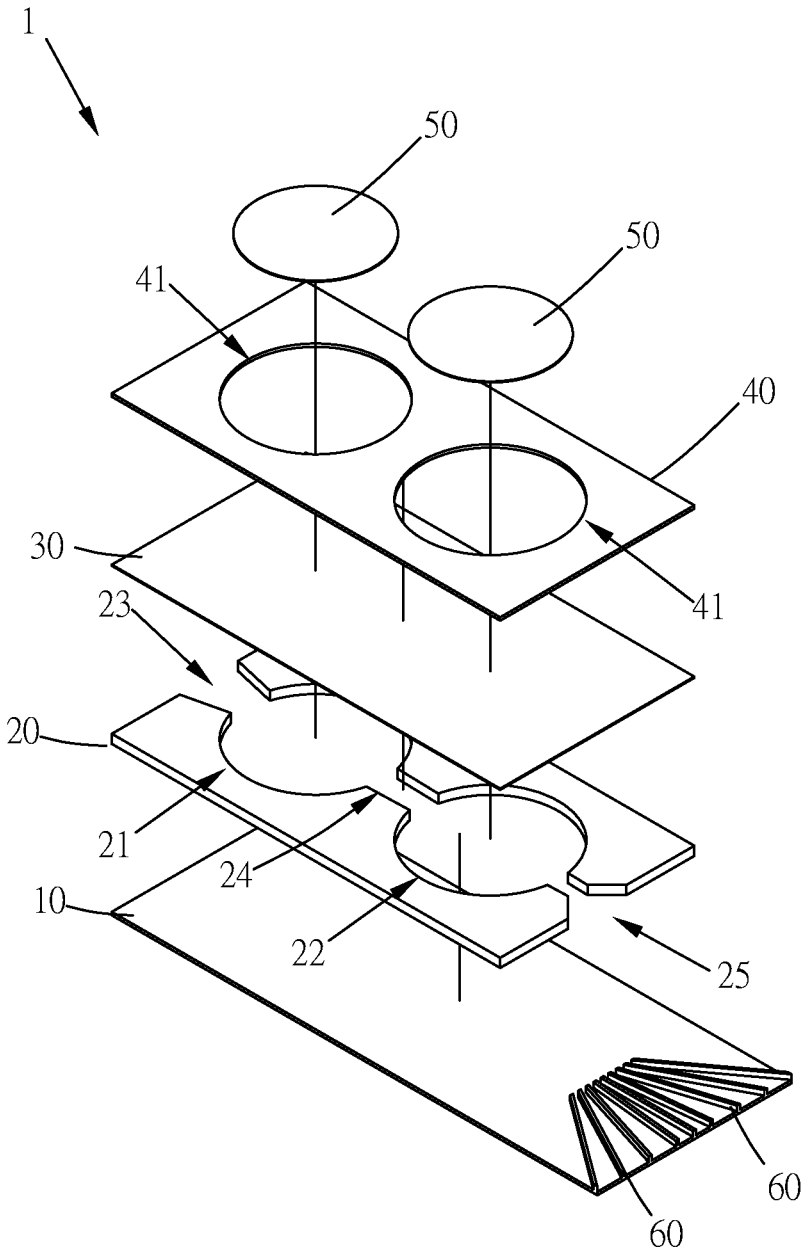
FIG. 3 illustrates an exploded assembly drawing of the miniature cooling system in the first embodiment of the present invention.
Figure 4:
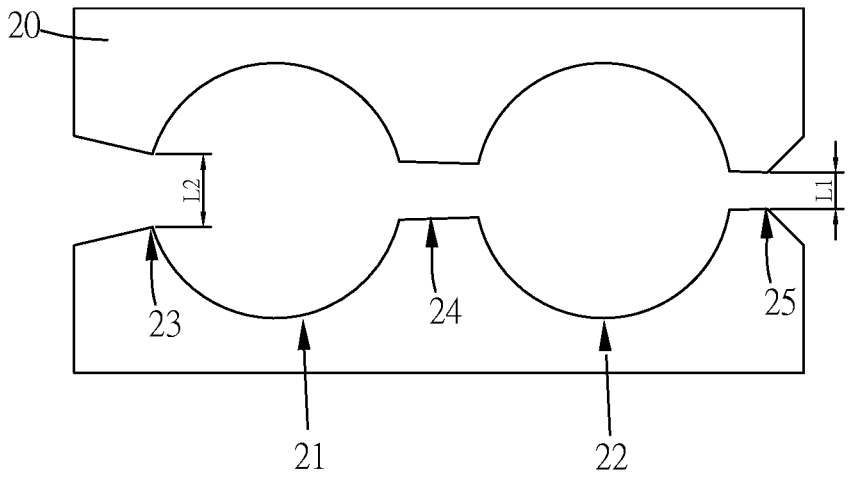
FIG. 4 illustrates a top view drawing of the flow channel layer in the first embodiment of the present invention.
Figure 5:
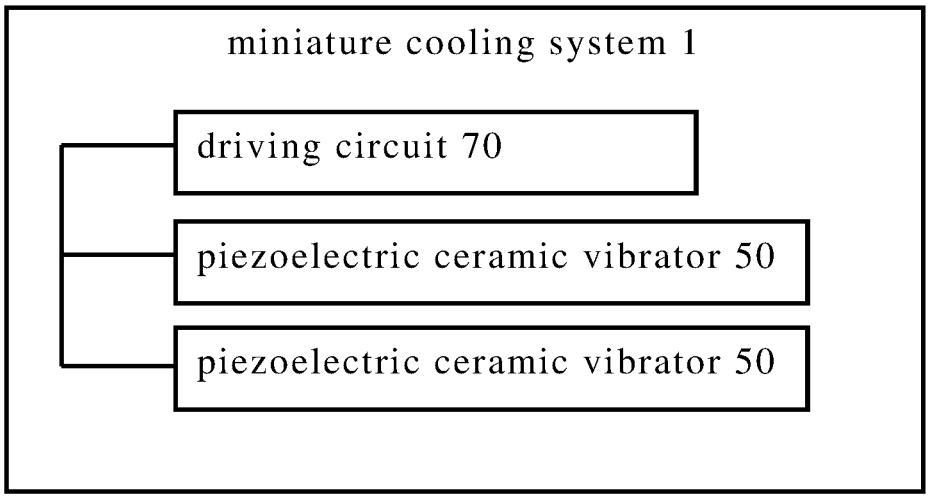
FIG. 5 illustrates a system structure drawing of the miniature cooling system in the first embodiment of the present invention.
Figure 6:
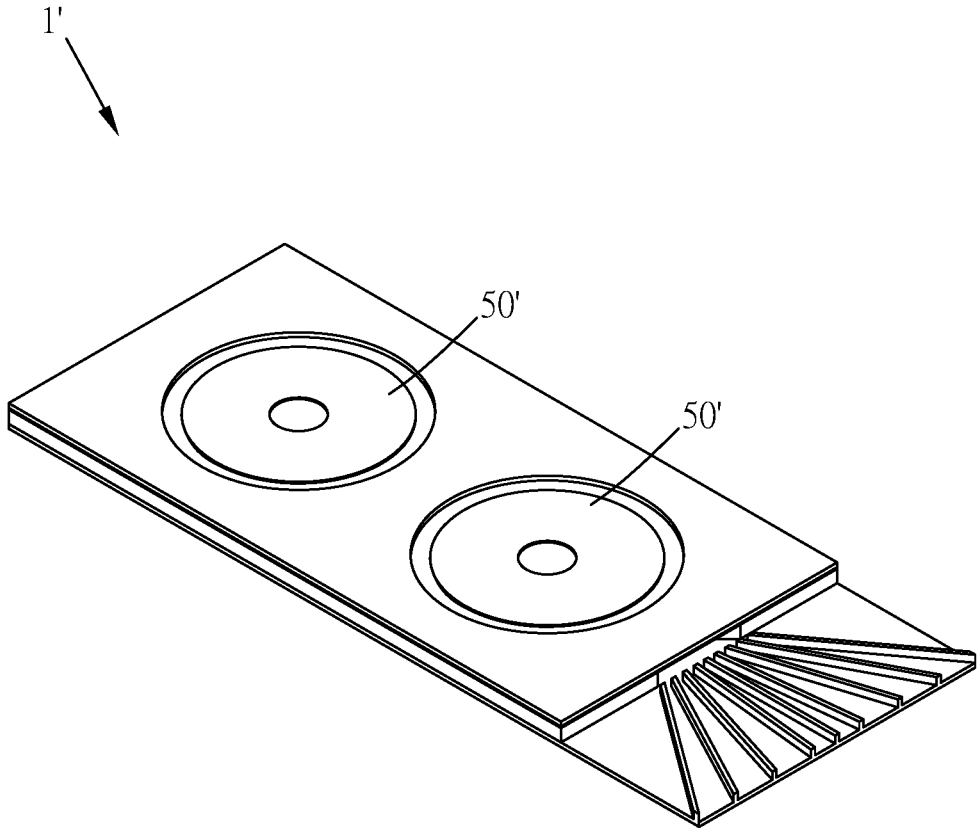
FIG. 6 illustrates a schematic drawing of another miniature cooling system in the first embodiment of the present invention.
Figure 7:
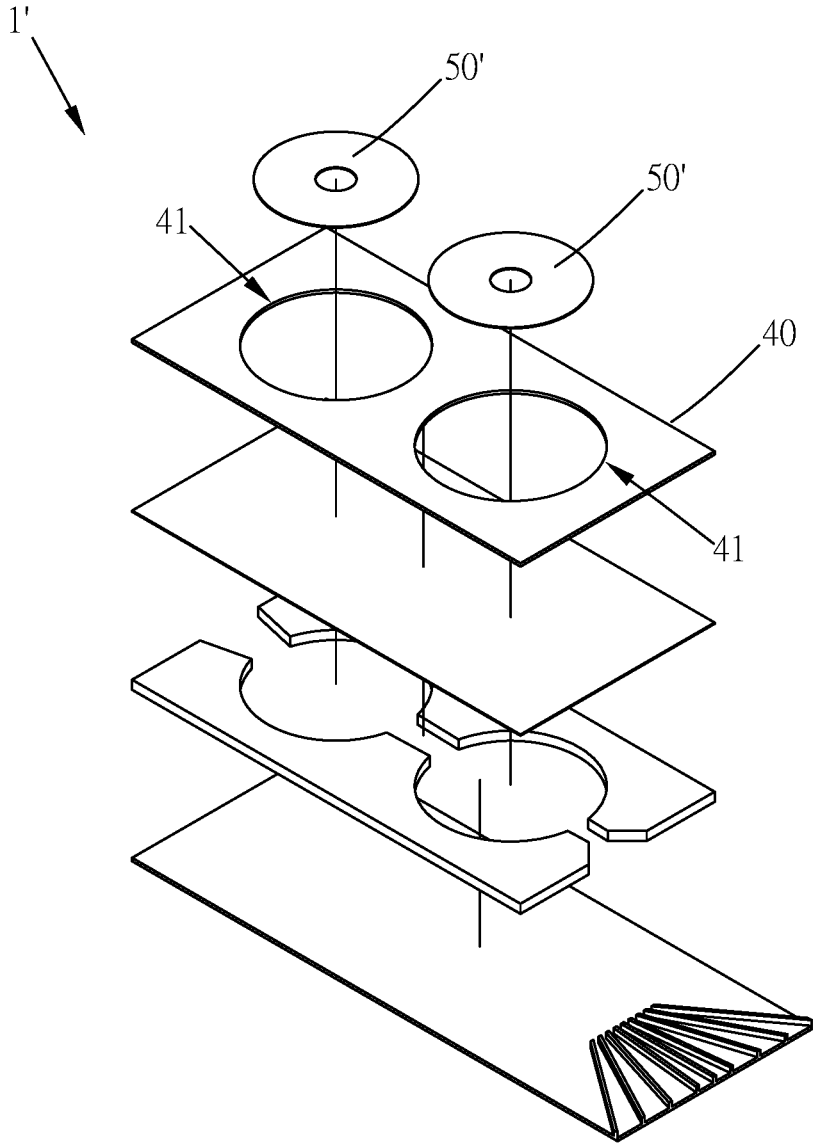
FIG. 7 illustrates an exploded assembly drawing of the miniature cooling system of the other type in the first embodiment of the present invention.

Please refer to FIG. 1 to FIG. 7, which illustrate the miniature cooling system in the first embodiment of the present invention. FIG. 1 illustrates a schematic drawing of the miniature cooling system installed on the electronic component of the portable electronic device in the first embodiment of the present invention. FIG. 2 illustrates a schematic drawing of the miniature cooling system in the first embodiment of the present invention. FIG. 3 illustrates an exploded assembly drawing of the miniature cooling system in the first embodiment of the present invention. FIG. 4 illustrates a top view drawing of the flow channel layer in the first embodiment of the present invention. FIG. 5 illustrates a system structure drawing of the miniature cooling system in the first embodiment of the present invention. FIG. 6 illustrates a schematic drawing of another miniature cooling system in the first embodiment of the present invention. FIG. 7 illustrates an exploded assembly drawing of the miniature cooling system of the other type in the first embodiment of the present invention.

As shown in FIG. 1 to FIG. 3, to solve the heat dissipation problem of the portable electronic device and improve the cooling efficiency, the miniature cooling system 1 of the present invention can be installed on an electronic component 200 (such as a central processing unit which generates heat easily) of a portable electronic device; via the special cavity channel design and the modal resonance vibration phase difference of the piezoelectric sheet structure with two cavities, the cavities expand and contract such that the insides of the cavities work as a check valve for increasing the directional exhaust volume and increasing heat dissipation efficiency. The miniature cooling system 1 of the present invention includes a base metal sheet 10, a flow channel layer 20, a piezoelectrically actuated metal sheet 30, a piezoelectric boundary compression layer 40, two piezoelectric ceramic vibrators 50, a plurality of fins 60 and a driving circuit 70. The thickness of the thin miniature cooling system 1 is less than or equal to 2 mm, such that the miniature cooling system 1 is suitable for installation in a portable electronic device.

As shown in FIG. 3 and FIG. 4, in the first embodiment of the present invention, the base metal sheet 10 is made of metal. The flow channel layer 20 is made of metal. The flow channel layer 20 is used for forming an air channel such that the high-temperature air will pass through the air channel to the outside environment to achieve the heat dissipation effect. The flow channel layer 20 includes a first chamber 21, a second chamber 22, an inlet channel 23, a linking channel 24 and an outlet channel 25. The first chamber 21 and the second chamber 22 are both circular or rectangular cavities. The inlet channel 23 links the outside environment to the first chamber 21. The linking channel 24 links the first chamber 21 and the second chamber 22. The outlet channel 25 links the second chamber 22 to the outside environment. The inlet channel 23 has a size L2, and the outlet channel 25 has a size L1. The size L2 of the inlet channel 23 is larger than the size L1 of the outlet channel 25. The range of the ratio of the size L1 of the outlet channel 25 to the size L2 of the inlet channel 23 is between 0.4 and 0.7. As determined by actual experiments of the inventor of the present invention, if the ratio range of the size L1 of the outlet channel 25 to the size L2 of the inlet channel 23 is between 0.4 and 0.7, the maximum air drawing capacity of the inlet channel 23 and the maximum exhaust capacity of the outlet channel 25 can be achieved to provide a strong cooling effect. However, the size or design of the inlet channel 23 and the outlet channel 25 are not limited to the abovementioned description, the size or design of the inlet channel 23 and the outlet channel 25 can be changed according to the requirement. Besides, a soft film and a valve switch (not shown in the figure) can be also installed to the linking channel 24; the soft film can open or close to adjust the air flow, the valve switch can work with the piezoelectrically actuated metal sheet 30 to bend, to help the high-temperature air pass through the air channel to the outside environment.

In the first embodiment of the present invention, the piezoelectrically actuated metal sheet 30 is an elastic phosphor bronze sheet, which is located on the flow channel layer 20. The base metal sheet 10 and the piezoelectrically actuated metal sheet 30 are respectively connected to the bottom surface and the top surface of the flow channel layer 20 such that chambers are formed between the base metal sheet 10, the flow channel layer 20 and the piezoelectrically actuated metal sheet 30.

In the first embodiment of the present invention, the piezoelectric boundary compression layer 40 is made of metal. The piezoelectric boundary compression layer 40 is connected to the piezoelectrically actuated metal sheet 30 and covers the piezoelectrically actuated metal sheet 30. The piezoelectric boundary compression layer 40 includes two containing areas 41. The two containing areas 41 are circular grooves which are respectively located in the first chamber 21 and the second chamber 22. Two parts of the piezoelectrically actuated metal sheet 30 are exposed from the two containing areas 41.

As shown in FIG. 3 and FIG. 5, in the first embodiment of the present invention, the size and the shape of the two piezoelectric ceramic vibrators 50 are corresponded to the containing areas 41 of the piezoelectric boundary compression layer 40. The center of each of the circular piezoelectric ceramic vibrators 50 is aligned with the center of the containing area 41. The piezoelectric ceramic vibrator 50 is located in the containing area 41 and connected to the piezoelectrically actuated metal sheet 30. When the piezoelectric ceramic vibrator 50 is driven by electricity to vibrate, the piezoelectric ceramic vibrator 50 and the piezoelectrically actuated metal sheet 30 will generate the modal resonance effect; via the size ratio of the piezoelectrically actuated metal sheet 30 and the containing area 41, the deformation effect of the maximum vibration displacement can be generated. However, as shown in the miniature cooling system 1' of FIG. 6 and FIG. 7, the two piezoelectric ceramic vibrators 50' can also be designed as a ring structure with a hollow space, whereby the ring structure can further increase the deformation effect. Furthermore, the piezoelectrically actuated metal sheet 30 can also protect the piezoelectric ceramic vibrator 50 and connect to the piezoelectric ceramic vibrator 50 to provide the single reed vibration effect. As shown in FIG. 1, the driving circuit 70 is located under the plurality of fins 60, and the driving circuit 70 is electrically connected to the two piezoelectric ceramic vibrators 50 and an external computer (not shown in the figure); the driving circuit 70 is controlled by the external computer to respectively provide two driving controlling powers to the two piezoelectric ceramic vibrators 50 such that the two piezoelectric ceramic vibrators 50 will vibrate at ultrasonic resonance frequencies. The vibration direction of the piezoelectric ceramic vibrators 50 and the inlet channel 23 are perpendicular to each other. When any one of the piezoelectric ceramic vibrators 50 vibrates, the piezoelectric ceramic vibrator 50 will also drive the piezoelectrically actuated metal sheet 30 to provide the single reed vibration effect.

In the first embodiment of the present invention, the plurality of fins 60 are connected to the base metal sheet 10, and the plurality of fins 60 are located next to the outlet channel 25. The plurality of fins 60 are arranged as a radial shape. The plurality of fins 60 are used for causing the heated air from the outlet channel 25 to flow to the outside environment more quickly.

When the user needs to use the miniature cooling system 1 for cooling, the user can use the external computer to operate the driving circuit 70 to cause the driving circuit 70 to provide the driving controlling powers to the two piezoelectric ceramic vibrators 50 such that the two piezoelectric ceramic vibrators 50 will vibrate along a vibration direction at an ultrasonic resonance frequency. When the two piezoelectric ceramic vibrators 50 vibrate at an ultrasonic resonance frequency, deformation will quickly be generated via the vibrations; via phase difference control, the two chambers will generate actuations with a phase difference to achieve an effective blower effect of larger flow volume and velocity.

When the piezoelectric ceramic vibrators 50 drive the piezoelectrically actuated metal sheet 30 with the phase difference, the volume of the first chamber 21 will expand and the volume of the second chamber 22 will contract; because of the tapered design of the channels, cool air will be drawn into the expanding first chamber 21 and exhausted from the minimum outlet of the contracting second chamber 22; thus, the cool air will become heated air via the heat exchange in the chambers. When the first chamber 21 contracts, the second chamber 22 will expand to draw the air such that the heated air in the two chambers will flow along a single direction to achieve an effective blower effect; finally, the fins 60 located next to the outlet channel 25 can further improve the cooling effect.

It is to be known that the modal resonance frequencies of each of the piezoelectric ceramic vibrators 50 in the first chamber 21 and the second chamber 22 provide an effective phase difference to control the amount of air drawn or exhausted between the first chamber 21 and the second chamber 22 to achieve a suitable exhaust amount of the outlet channel 25 and provide the alternating exhausting and superimposed outputting effect, and to provide a muting effect when vibrating at an ultrasound frequency for modal resonance. According to actual experiments performed by the applicant of this invention, when the phase difference in the vibration frequencies of each of the piezoelectric ceramic vibrators 50 is 120°, a larger amount of exhaust can be achieved. However, the phase difference in the vibration frequency is not limited to 120°; the phase difference in the vibration frequency can be adjusted according to the chamber structure to achieve the best effect.

Figure 8:
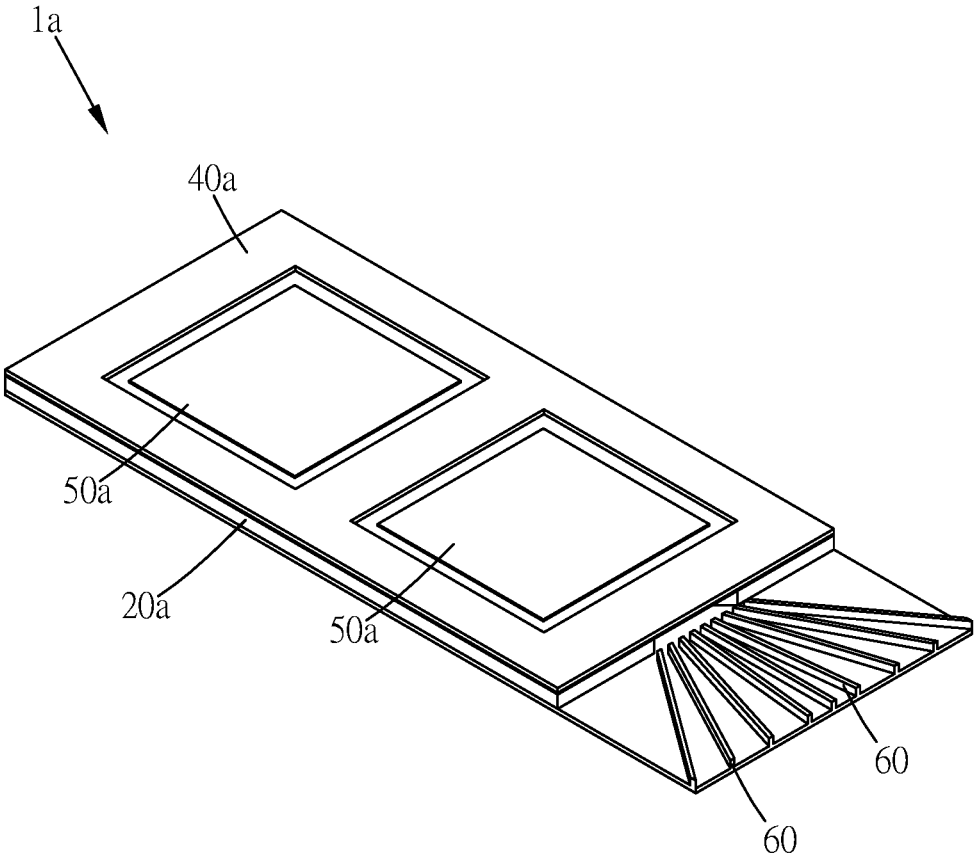
FIG. 8 illustrates a schematic drawing of the miniature cooling system in the second embodiment of the present invention.
Figure 9:
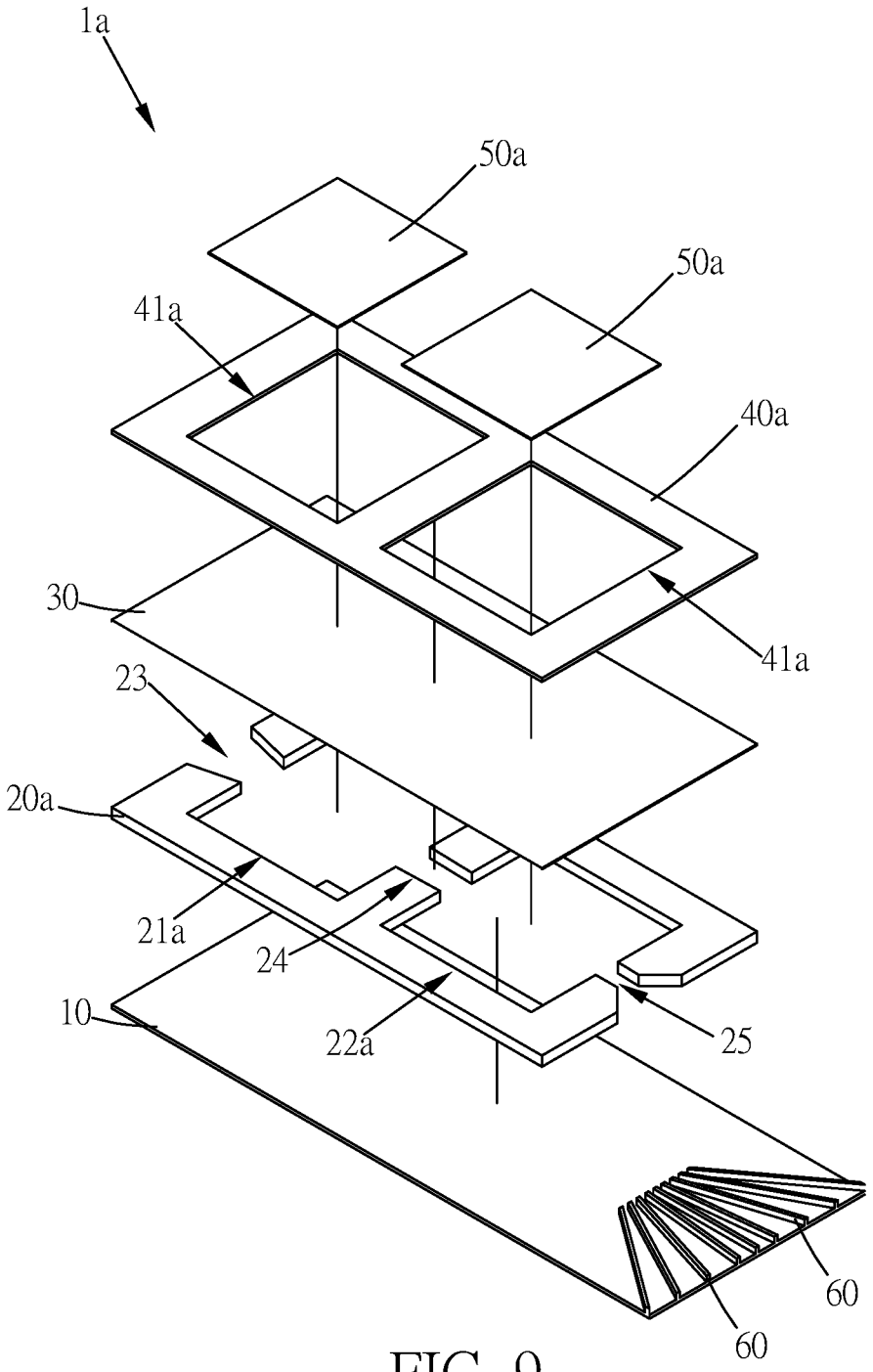
FIG. 9 illustrates an exploded assembly drawing of the miniature cooling system in the second embodiment of the present invention.
Figure 10:
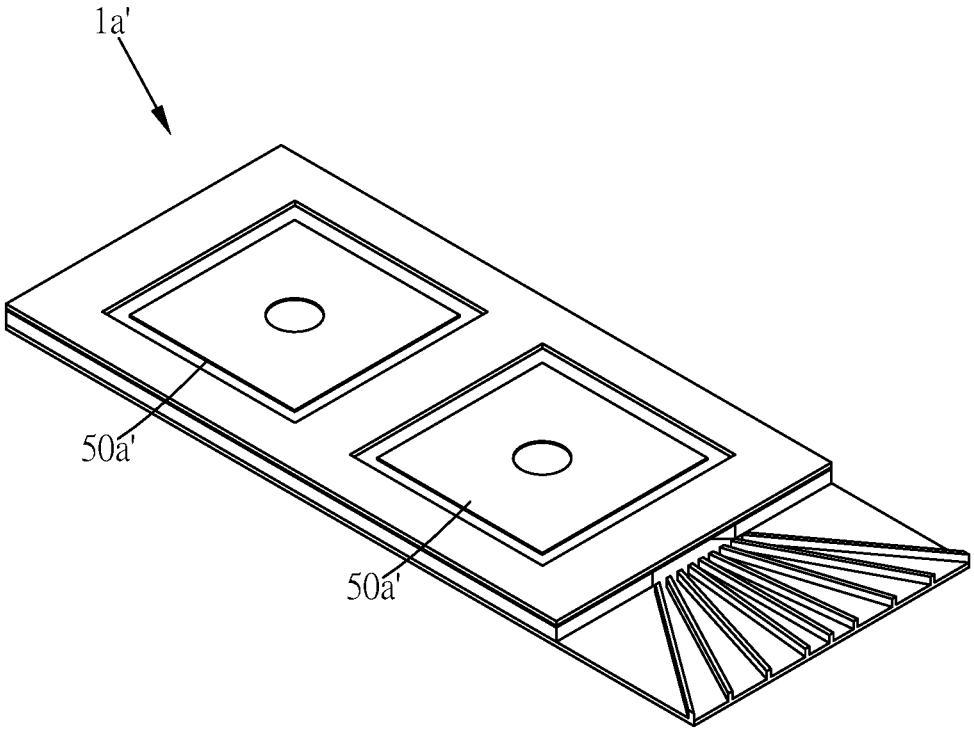
FIG. 10 illustrates a schematic drawing of another miniature cooling system in the second embodiment of the present invention.
Figure 11:
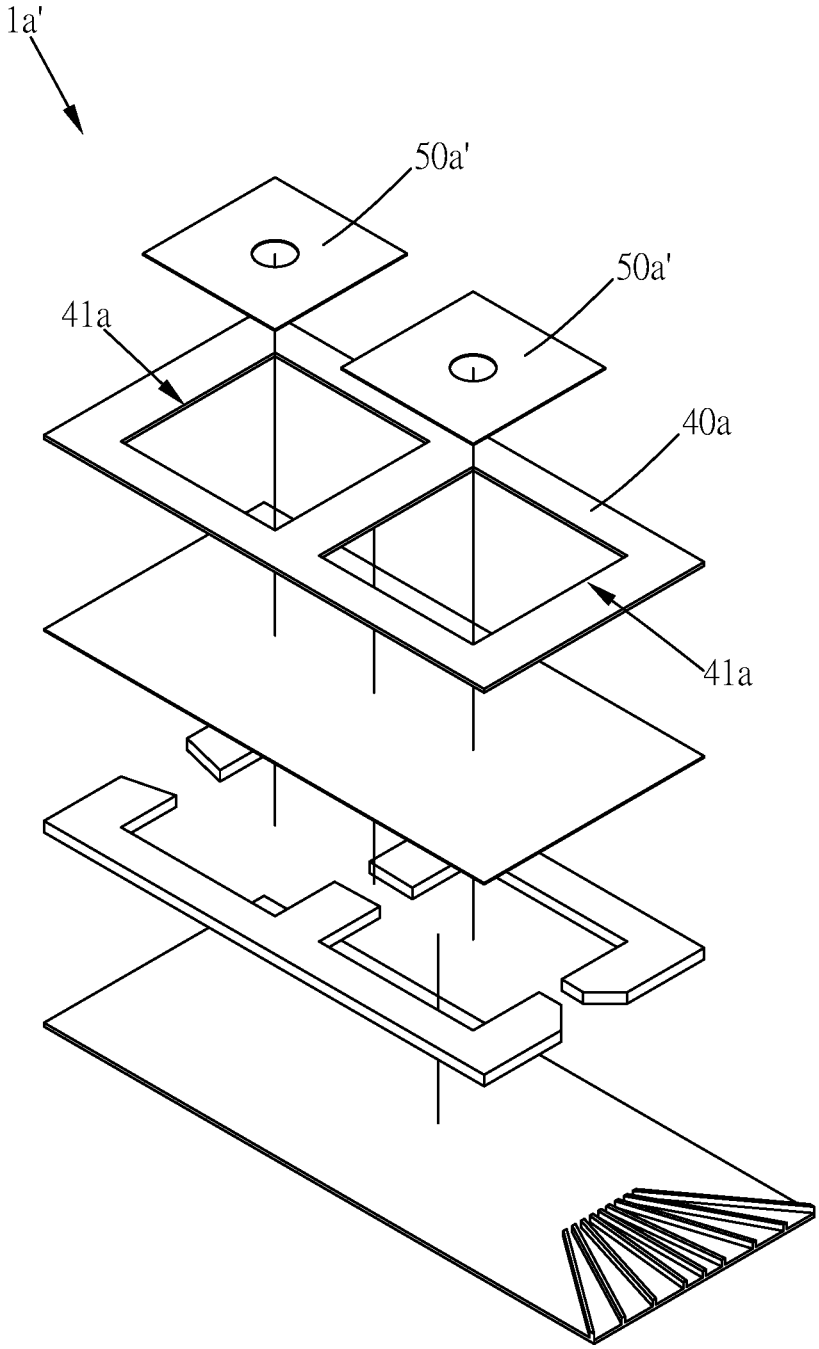
FIG. 11 illustrates an exploded assembly drawing of the miniature cooling system of the other type in the second embodiment of the present invention.

Please refer to FIG. 8 to FIG. 11, which illustrate the miniature cooling system in the second embodiment of the present invention. FIG. 8 illustrates a schematic drawing of the miniature cooling system in the second embodiment of the present invention. FIG. 9 illustrates an exploded assembly drawing of the miniature cooling system in the second embodiment of the present invention. FIG. 10 illustrates a schematic drawing of another miniature cooling system in the second embodiment of the present invention. FIG. 11 illustrates an exploded assembly drawing of the miniature cooling system of the other type in the second embodiment of the present invention.

As shown in FIG. 8 and FIG. 9, the difference between the second embodiment and the first embodiment is that, in the miniature cooling system 1*a* of the second embodiment, the first chamber 21*a* and the second chamber 22*a* of the flow channel layer 20*a* are both square cavities, the two containing areas 41*a* of the piezoelectric boundary compression layer 40*a* are square grooves, and the two piezoelectric ceramic vibrators 50*a* are corresponding square films. The center of each of the square piezoelectric ceramic vibrators 50*a* is aligned with the center of the containing area 41*a* and connected to the piezoelectrically actuated metal sheet 30. However, as shown in the miniature cooling system 1*a*' of FIG. 10 and FIG. 11, the piezoelectric ceramic vibrator 50*a*' of the second embodiment can also be a hollow square, a hollow flexible groove structure is formed at two opposite sides of the piezoelectric ceramic vibrator 50*a*' corresponded to the piezoelectrically actuated metal sheet 30, and the other two sides are bonded rigidly to the piezoelectrically actuated metal sheet 30 and the piezoelectric boundary compression layer 40*a*; via the hollow flexible groove structure, the containing area 41*a* and the piezoelectrically actuated metal sheet 30 can easily cause arch modal resonance, and the hollow piezoelectric ceramic vibrator 50*a* can further increase the arch deformation. Comparing the second embodiment and the first embodiment, the chamber of the miniature cooling system 1*a* has the same area as that of the miniature cooling system 1, but the miniature cooling system 1*a* can execute the arch reed vibration effect to provide a larger exhaust amount and increase the cooling effect, and the square cavity structure is easy to produce.

To verify the advantage of the miniature cooling system of the present invention, the applicant further executed actual experiments to compare the cooling effects of the miniature cooling system and the other cooling system. The applicant respectively provided electric power of 20 volts to the miniature cooling system with two chambers and two piezoelectric ceramic vibrators connected to the piezoelectrically actuated metal sheet of the present invention, to a cooling system (hereinafter referred to as comparative example 1) with only one chamber and a piezoelectric sheet connected to a metal layer, and to another cooling system (hereinafter referred to as comparative example 2) with two chambers and a piezoelectric sheet unconnected to a metal layer, causing the piezoelectric sheet of each of the cooling systems to vibrate, and the applicant further recorded the amplitudes of the piezoelectric sheets. Note that, though amplitude is not the only determinant factor influential to the output (exhaust air volume and velocity), larger amplitude associated with appropriate vibration mode shape usually produce better output. According to the results of the actual experiments, the piezoelectric ceramic vibrator of the miniature cooling system of the present invention provides an amplitude of 10.8 μM, the piezoelectric sheet of the cooling system of comparative example 1 only provides an amplitude of 5.91 μm, and the piezoelectric sheet of the cooling system of comparative example 2 only provides an amplitude of 7.32 μm, thus, it is clear that the miniature cooling system of the present invention can provide the largest amplitude, such that the volume of the two chambers will be affected by the amplitude of the piezoelectric ceramic vibrator and change greatly to increase the exhaust amount of the channel and to increase the cooling effect.

Due to the design of the miniature cooling system of the present invention, the miniature cooling system can be installed in an electronic component of a portable electronic device; the two chambers and the vibration phase difference of the piezoelectric sheet connected to the piezoelectrically actuated metal sheet make the inside of the chamber perform as a check value to increase the exhaust amount, and to increase the cooling effect.

In summary, regardless of the purposes, means and effectiveness, this invention is quite different from the known technology and should merit the issuing of a new patent. However, it is noted that many of the above-mentioned embodiments are only for illustrative purposes; the claims of the invention should depend on the claims and not be limited to the embodiments.

What is claimed is:

1. A miniature cooling system, comprising:

a base metal sheet;

a flow channel layer, located on the base metal sheet, wherein the flow channel layer comprises:

a first chamber;

a second chamber;

an inlet channel, linking the outside environment to the first chamber;

a linking channel, linking the first chamber and the second chamber; and an outlet channel, linking the second chamber to the outside environment, wherein the outlet channel is shaped as a funnel, the outlet channel has an inner size and an outlet size, and the inner size is smaller than the outlet size;

a piezoelectrically actuated metal sheet, located on the flow channel layer;

a piezoelectric boundary compression layer, located on the piezoelectrically actuated metal sheet, wherein the piezoelectric boundary compression layer comprises two containing areas, and the two containing areas are respectively located above the first chamber and the second chamber; and two piezoelectric ceramic vibrators, each respectively located in the two containing areas and respectively aligned with the centers of the two containing areas, and located on the piezoelectrically actuated metal sheet.

2. The miniature cooling system as claimed in claim 1, wherein the two piezoelectric ceramic vibrators are connected to the piezoelectrically actuated metal sheet, and two parts of the piezoelectrically actuated metal sheet are exposed from the two containing areas.

3. The miniature cooling system as claimed in claim 2, further comprising a driving circuit, wherein the driving circuit is electrically connected to the two piezoelectric ceramic vibrators, and the driving circuit is used for providing two driving controlling powers such that the two piezoelectric ceramic vibrators vibrate along a vibration direction.

4. The miniature cooling system as claimed in claim 3, wherein the inlet channel and the vibration direction are perpendicular to each other.

5. The miniature cooling system as claimed in claim 4, further comprising a plurality of fins, the plurality of fins being connected to the base metal sheet.

6. The miniature cooling system as claimed in claim 5, wherein the plurality of fins are located next to the outlet channel.

7. The miniature cooling system as claimed in claim 6, wherein the inlet channel has a size and the outlet channel has a size; the size of the inlet channel is larger than the size of the outlet channel.

8. The miniature cooling system as claimed in claim 7, wherein a range of the ratio of the size of the outlet channel to the size of the inlet channel is between 0.4 and 0.7.

9. The miniature cooling system as claimed in claim 8, wherein the first chamber and the second chamber are both circular cavities, the two containing areas are both circular grooves, and the two piezoelectric ceramic vibrators are corresponding circular films; or the first chamber and the second chamber are both rectangular cavities, the two containing areas are both rectangular grooves, and the two piezoelectric ceramic vibrators are corresponding rectangular films.

10. The miniature cooling system as claimed in claim 9, wherein the two piezoelectric ceramic vibrators vibrate at a frequency above 20,000 Hz.

* * * * *